US007735956B2

(12) United States Patent
Usui et al.

(10) Patent No.: US 7,735,956 B2
(45) Date of Patent: Jun. 15, 2010

(54) RECOVERY DEVICE AND RECOVERY METHOD

(75) Inventors: Takamasa Usui, Ogaki (JP); Katsunori Nishida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 291 days.

(21) Appl. No.: 12/029,936

(22) Filed: Feb. 12, 2008

(65) Prior Publication Data

US 2008/0192082 A1 Aug. 14, 2008

(30) Foreign Application Priority Data

Feb. 13, 2007 (JP) ..... 2007-031590

(51) Int. Cl.
*B41J 2/165* (2006.01)

(52) U.S. Cl. ..... 347/29; 347/30

(58) Field of Classification Search ..... 347/29, 347/30, 32, 33

See application file for complete search history.

(56) References Cited

U.S. PATENT DOCUMENTS

2002/0012023 A1* 1/2002 Shigeno ..... 347/29

FOREIGN PATENT DOCUMENTS

EP 1092667 A2 10/2000
EP 1616827 A1 10/2000
JP H09-239995 A 9/1997
JP H11-314376 A 11/1999
JP 2001-106433 A 4/2001
JP 2002-254664 A 9/2002
JP 2003-103804 A 4/2003
JP 2004-276270 A 10/2004
JP 2005-246879 A 9/2005

OTHER PUBLICATIONS

Computer-generated translation of JP 11-314376 cited in the IDS filed on Feb. 12, 2008.*

* cited by examiner

*Primary Examiner*—Huan H Tran
(74) *Attorney, Agent, or Firm*—Baker Botts L.L.P

(57) ABSTRACT

A recovery device comprising: a cap configured to cover a nozzle face in which a plurality of nozzle groups are formed; and a cap holder supporting the cap; wherein the cap includes: a sealing lip being configured to sealingly contact the nozzle face; a plurality of partitioning lips that partition an inside area surrounded by the sealing lip into a plurality of compartments corresponding to the respective nozzle groups; and a plurality of suction openings provided in the respective compartments; and wherein a common flow path, which is communicated with suction openings of some or all compartments and connects the suction openings to a negative pressure source, is formed in the cap or in the cap holder, or by a space containing faces of the cap and the cap holder opposed to each other.

15 Claims, 8 Drawing Sheets

RECOVERY DEVICE AND RECOVERY METHOD

CROSS REFERENCE TO RELATED APPLICATION

The present application claims priority from Japanese Patent Application No. 2007-031590, which was filed on Feb. 13, 2007, the disclosure of which is herein incorporated by reference in its entirety.

TECHNICAL FIELD

The present invention relates to a recovery device and a recovery method for a nozzle head, especially for recovering a function of the nozzle head that discharges liquids from a plurality of nozzle groups.

BACKGROUND

Conventionally, a recovery device for a nozzle head has a cap, the cap covers a nozzle face of the nozzle head on which a plurality of nozzle groups are formed. This cap realizes a capping process by contacting a tip end of an annular sealing lip formed of elastic material to the nozzle face. Moreover, as described in Japanese Publication of Unexamined Patent Applications No. JP-A-11-314376, an inside area of the sealing lip is partitioned by partitioning lip into a plurality of compartments, so that a plurality of the nozzle groups can be enclosed in these compartments for respective groups. The compartments comprise the suction openings for liquids respectively, the suction openings are communicated with exterior sucking unit independently from one another. And, when a negative pressure is created inside the sealing lip, it is possible to suck the liquids independently from the respective nozzle groups by way of the respective suction openings.

The recovery device comprising such a cap has following disadvantages. In case where the nozzle groups on the nozzle face (for example, rows of the nozzles) are increased in number in order to improve a performance of the nozzle head, an area of the cap must be increased correspondingly, which is undesirable from a view point of making the device compact. Moreover, in case where the area of the cap is increased, a bottom of the cap tends to be deformed due to the negative pressure created in the cap and comes into a state warped toward the nozzle face, when the liquids are sucked from the nozzle groups through the respective compartments. Therefore, there is such anxiety that the bottom of the cap may get in touch with the nozzle face, and the following countermeasures are considered.

(1) To provide a distance between the bottom of the cap and the nozzle face, by increasing heights of the sealing lip and the partitioning lips.

(2) To suppress deformation by increasing thickness of the bottom of the cap.

(3) To suppress deformation by bonding a plate of rigid material (such as stainless steel) to a back face of the bottom of the cap.

(4) To enhance rigidity by integrally molding the cap with a holder for holding the cap.

(5) To employ rubber having high hardness, as material for the cap.

SUMMARY

However, for example, in case of the above described countermeasure (1), by increasing the heights of the sealing lip and the partitioning lips, the cap is likely to be deformed in a lateral direction of the cap (likely to fall, in short), and so, there is such anxiety that the nozzle groups on the nozzle face may get in touch with the sealing lip and the partitioning lips.

The present invention can provide, as one of illustrative, non-limiting embodiment, a recovery device for a nozzle head that has a nozzle face in which a plurality of nozzle groups are formed, the recovery device comprising: a cap configured to cover the nozzle face in which a plurality of nozzle groups are formed; and a cap holder supporting the cap; wherein the cap includes: a sealing lip being configured to sealingly contact the nozzle face in a state in which the sealing lip covers the nozzle groups; a plurality of partitioning lips that partition an inside area surrounded by the sealing lip into a plurality of compartments corresponding to the respective nozzle groups; and a plurality of suction openings provided in the respective compartments, liquid can be exhausted through the suction openings; and wherein a common flow path, which is communicated with suction openings of some or all compartments and connects the suction openings to a negative pressure source, is formed in the cap or in the cap holder, or by a space containing faces of the cap and the cap holder opposed to each other.

And, the present invention can provide, as one of illustrative, non-limiting embodiment, a recovery method for a nozzle head that has a nozzle face in which a plurality of nozzle groups are formed, the recovery method comprising the steps of: covering the nozzle face with a cap supported by a cap holder; contacting a sealing lip disposed on the cap to the nozzle face; partitioning an inside area surrounded by the sealing lip into a plurality of compartments corresponding to the respective nozzle groups with a plurality of partitioning lips; keeping pressure of some or all compartments to be substantially equal through a common flow path, the common flow path is communicated with suction openings provided in the some or all compartments, the common flow path is formed in the cap or in the cap holder, or by a space containing faces of the cap and the cap holder opposed to each other; exhausting liquid from the nozzle head in a state in which pressure of the some or all compartments is kept to be substantially equal.

BRIEF DESCRIPTION OF THE DRAWINGS

Illustrative aspects of the invention will be described in detail with reference to the following figures wherein.

DETAILED DESCRIPTION OF THE PREFERRED EMBODIMENTS

Figure 1:
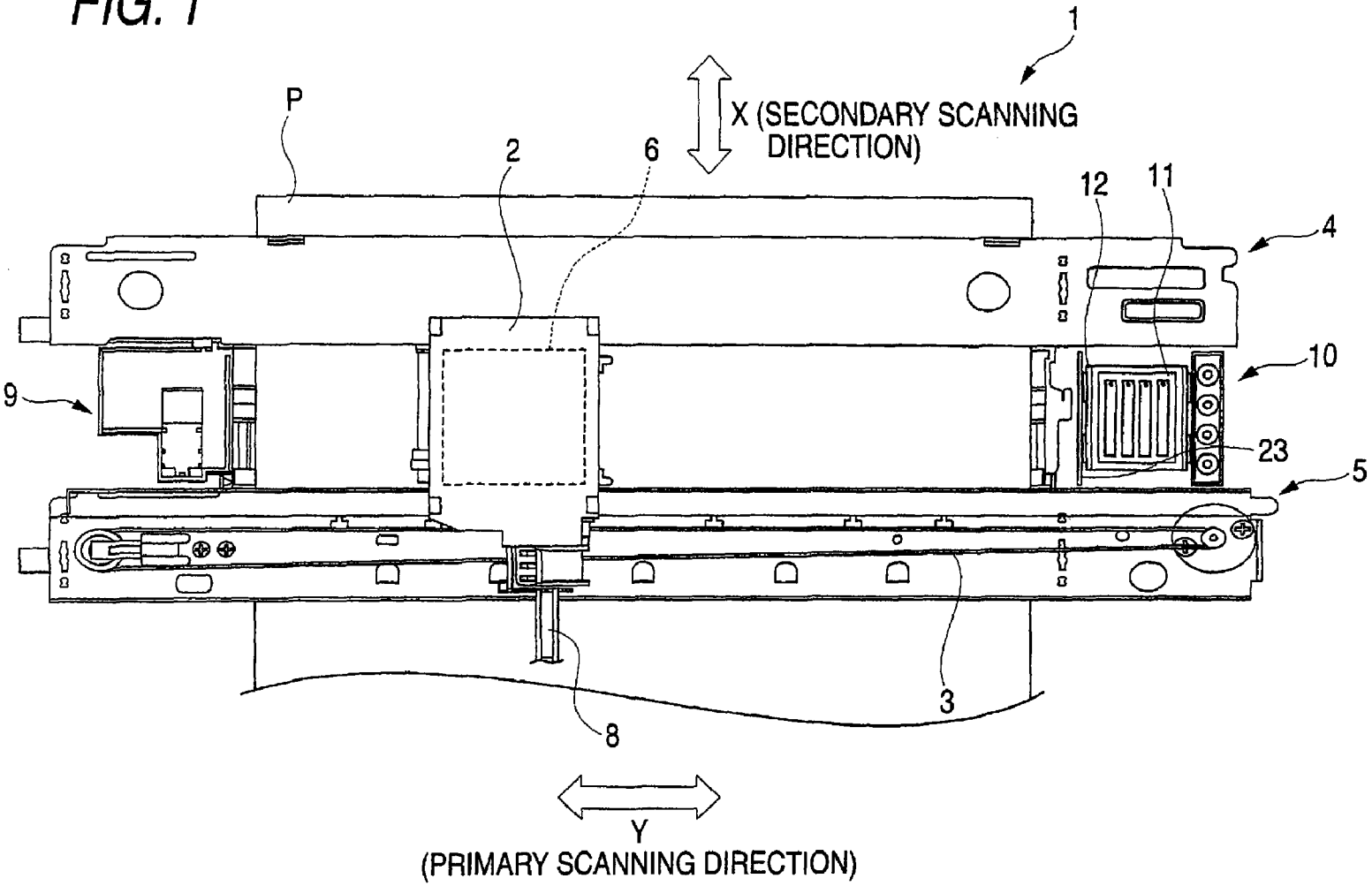
FIG. 1 is a schematic plan view showing a mechanism for executing image formation in an inkjet image forming apparatus which includes a recovery device of a nozzle head.

Illustrative, non-limiting exemplary embodiments of the present invention will be described in detail with reference to a recovery device and recovery method.

In addition, as described in the article of BACKGROUND, for example, in case of the above described countermeasure (1), by increasing the heights of the sealing lip and the partitioning lips, the cap is likely to be deformed in a lateral direction of the cap (likely to fall, in short), and so, there is such anxiety that the nozzle groups on the nozzle face may get in touch with the sealing lip and the partitioning lips. In case of the countermeasure (2), effects are too small only by increasing the thickness of the bottom of the cap, and warpage of the bottom cannot be prevented. In case of the countermeasure (3), production steps are increased because of bonding, which results in increase of cost. In case of the countermeasure (4), it is difficult to select suitable material because the cap formed of elastic material and the holder formed of resin must be integrally molded, which results in increase of the cost. In case of the countermeasure (5), a capping load must be increased, because sealing performance of the cap is lowered, and accordingly, high rigidity of the nozzle head is required, which leads to increase of burdens on design and production.

Under the circumstances, as a structure for reducing the cost, and at the same time, for preventing contact of the cap with the nozzle groups, it has been considered to employ the cap based on the above described (1) and (2), and further, to insert a resin piece, called as a chip, into the sealing lip of the cap, thereby to enhance the rigidity of the cap and suppress the deformation. In this case, however, there has been such anxiety that the lip falls due to deforming force exerted on the cap and the chip is detached, or the deformation cannot be fully suppressed even though the chip is inserted, and the lips may get in touch with the nozzle face together with the chip. Further, in case where the nozzle groups are increased in number, the area of the cap becomes larger, and the deforming force to be exerted on the cap becomes also larger than ever. Consequently, there is a limit for suppressing the deformation in case of employing the chip.

In view of the above, it is an object of the exemplary embodiments to provide a recovery device of a nozzle head which can reliably and effectively recover a function of the nozzle head with a simple structure of a cap, while deformation at a time of recovering the function is prevented, and a recovery method of the nozzle head which can reliably recover the function of the nozzle head, while the deformation is suppressed and the structure of the cap is simplified.

As an example of embodiments for realizing the recovery device and the recovery method of the nozzle head according to the invention, an inkjet image forming apparatus will be described referring to FIGS. 1 to 7. FIG. 1 is a schematic plan view showing an outline of a mechanism for executing image formation, in an inkjet image forming apparatus 1. Reference numeral 2 designates a head holder which serves also as a carriage which reciprocates in a lateral direction of paper P (a primary scanning direction: an arrow Y) This head holder 2 is driven by an endless belt 3. Moreover, as shown in FIG. 1, the inkjet image forming apparatus 1 comprises a pair of guide members 4 and 5 which are arranged separately in a feeding direction of the paper P (a secondary scanning direction: an arrow X) The head holder 2 moves along a pair of the guide members 4, 5. In the following description, a direction in which ink is ejected to the paper is referred to as a downward direction, and a direction opposite to the downward direction is referred to as an upward direction. In the same manner, a face opposed to a paper surface on which an image is formed is referred to as a lower face, and a face at an opposite side to the lower face is referred to as an upper face.

Figure 2:
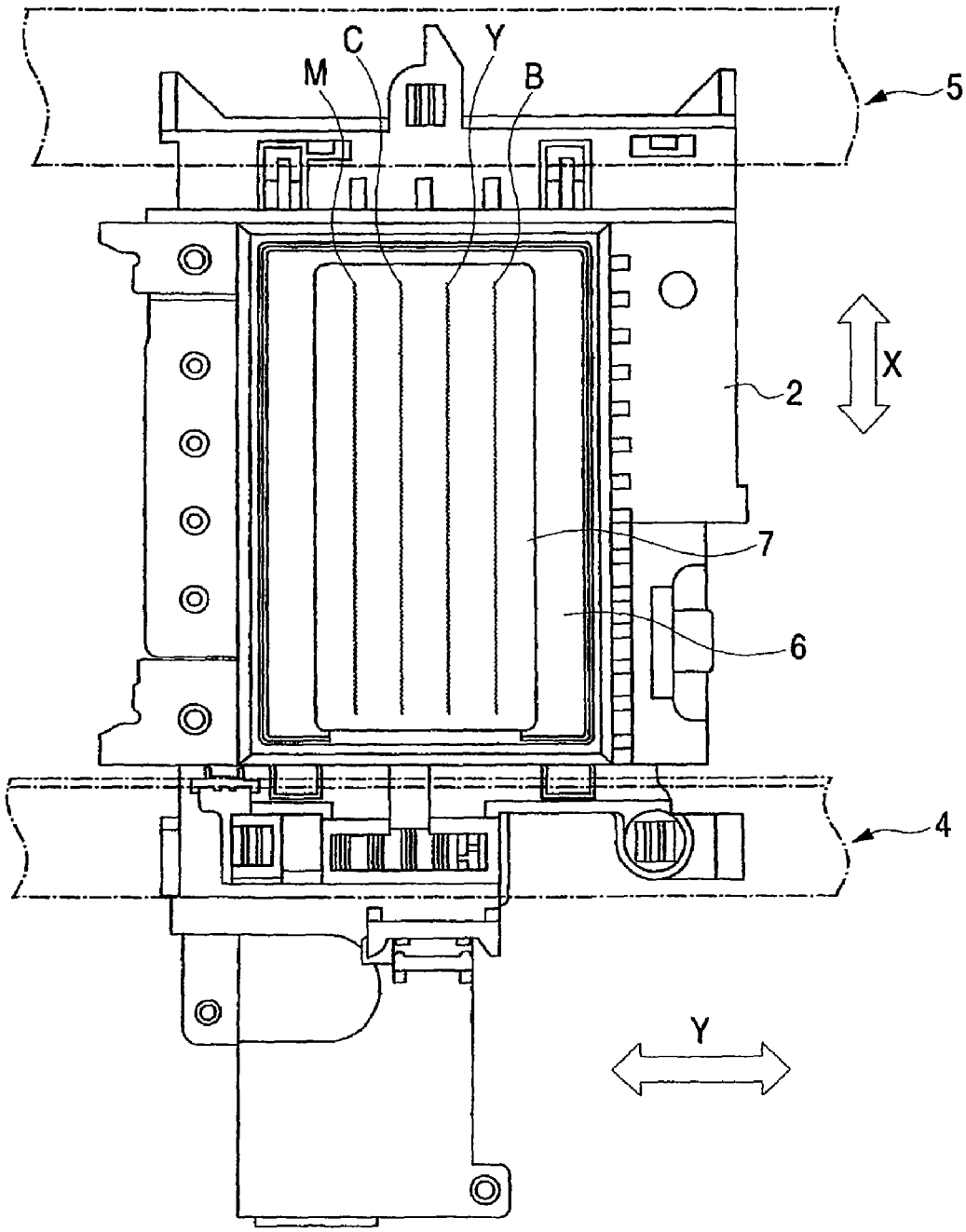
FIG. 2 is an enlarged view of a part showing a face where a head holder in FIG. 1 is opposed to paper P.

As shown in FIG. 2, a nozzle head 6 for ejecting the ink to form an image is provided on the face of the head holder 2 which is opposed to the paper P (the lower face), and the nozzle head 6 has a nozzle face 7 which is opposed to the paper P. Four rows of nozzle groups B, Y, C and M are provided on the nozzle face 7 at determined intervals in the primary scanning direction. A plurality of nozzles for ejecting the ink are arranged on the four rows of the nozzle groups linearly in the secondary scanning direction. At one end (the right end in FIG. 2) of these nozzle groups B, Y, C, M, there is a nozzle group B which ejects black ink. A nozzle group Y for yellow ink, a nozzle group C for cyan ink, and a nozzle group M for magenta ink are arranged sequentially from the black nozzle group B for the black ink. Reference numeral 8 designates a tube for supplying the inks to the nozzle head 6 in the head holder 2 from ink tanks (not shown) for the respective colors, the ink tanks are placed separately. While the paper P is forwarded in the secondary scanning direction and the head holder 2 is reciprocated in the primary scanning direction, the inks are ejected from the respective nozzle groups B, Y, C, M of the nozzle head 6 thereby to perform recording on the paper P.

As shown in FIG. 1, a flushing station 9 is additionally provided at one end of an area in which the head holder 2 moves in the primary scanning direction. The flushing station 9 is a member for receiving the inks which have been ejected from the respective nozzle groups B, Y, C, M of the nozzle head 6 irrespective of image forming operation. Because the ejection irrespective of the image forming operation is conducted in the flushing station 9, the ink having increased viscosity or bubbles formed in ink flow paths in the nozzle head 6 are ejected, whereby clogs at the nozzles are prevented or eliminated. In this manner, ejecting function of the respective nozzle groups B, Y, C, M of the nozzle head 6 is maintained and recovered in the inkjet image forming apparatus 1.

Moreover, a recovery device 10 for sucking the inks from the respective nozzle groups B, Y, C, M of the nozzle head 6 is provided at the other end of the area in which the head holder 2 moves in the primary scanning direction, the recovery device 10 is opposite to the flushing station 9 on the area in which the head holder 2 moves in. The recovery device 10 executes a process of sucking the inks periodically or according to switching operation of a user. In the inkjet image forming apparatus 1, the inks having increased viscosity or bubbles formed in the ink flow paths of the nozzle head 6 are exhausted, by sucking the inks from the respective nozzle groups B, Y, C, M by means of this recovery device 10, whereby the ejecting functions of the respective nozzle groups B, Y, C, M are recovered. This recovery device 10 can also prevent the respective nozzle groups B, Y, C, M from being dried or soiled with dust, while the image forming process is not executed. In addition, a wipe member 23 for cleaning the nozzle face after the sucking process is provided next to the recovery device 10.

Figure 3A:
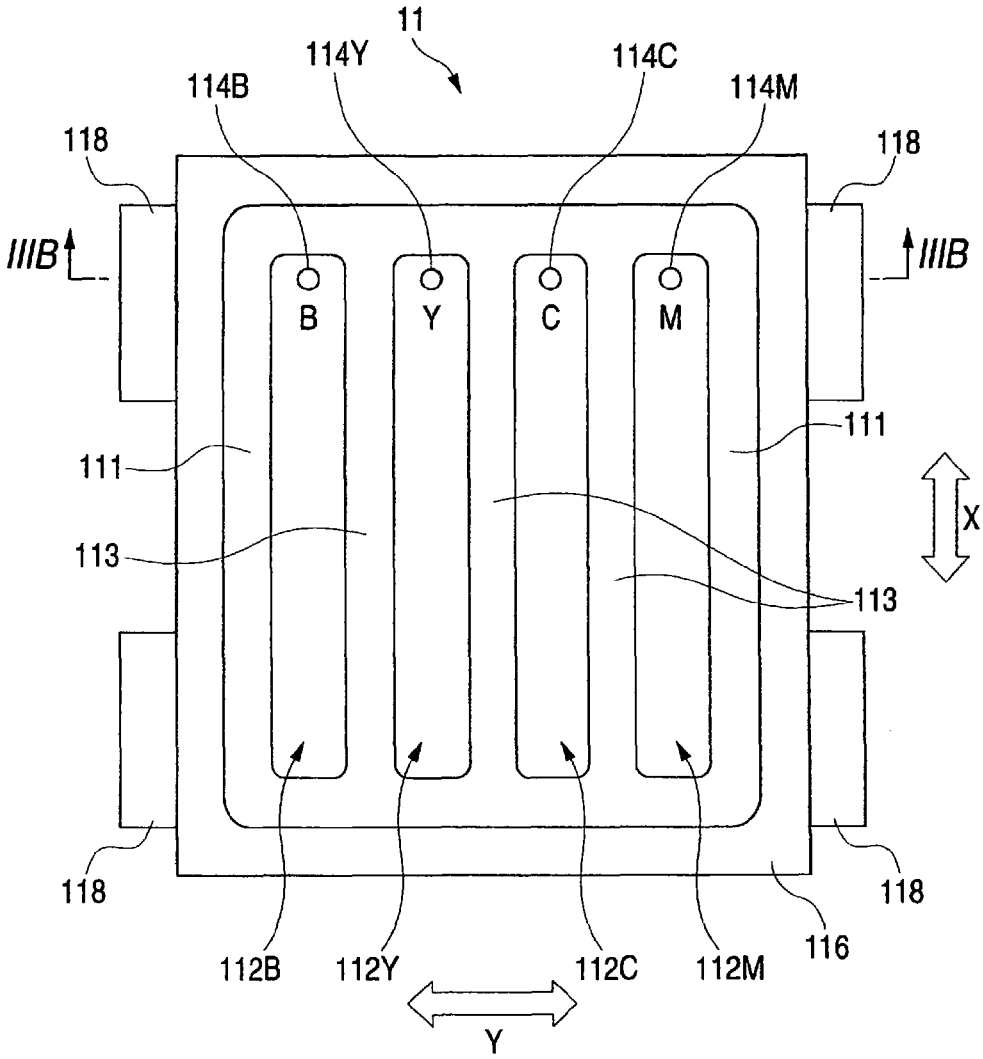
FIG. 3A is a plan view of a cap.
Figure 3B:
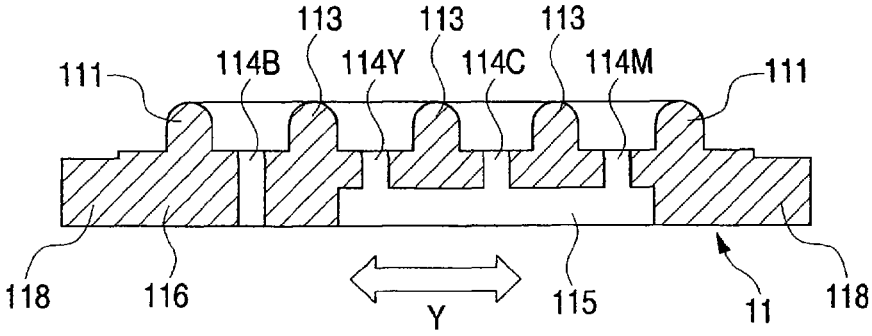
FIG. 3B is a sectional view taken along a line IIIB-IIIB in FIG. 3A.
Figure 4:
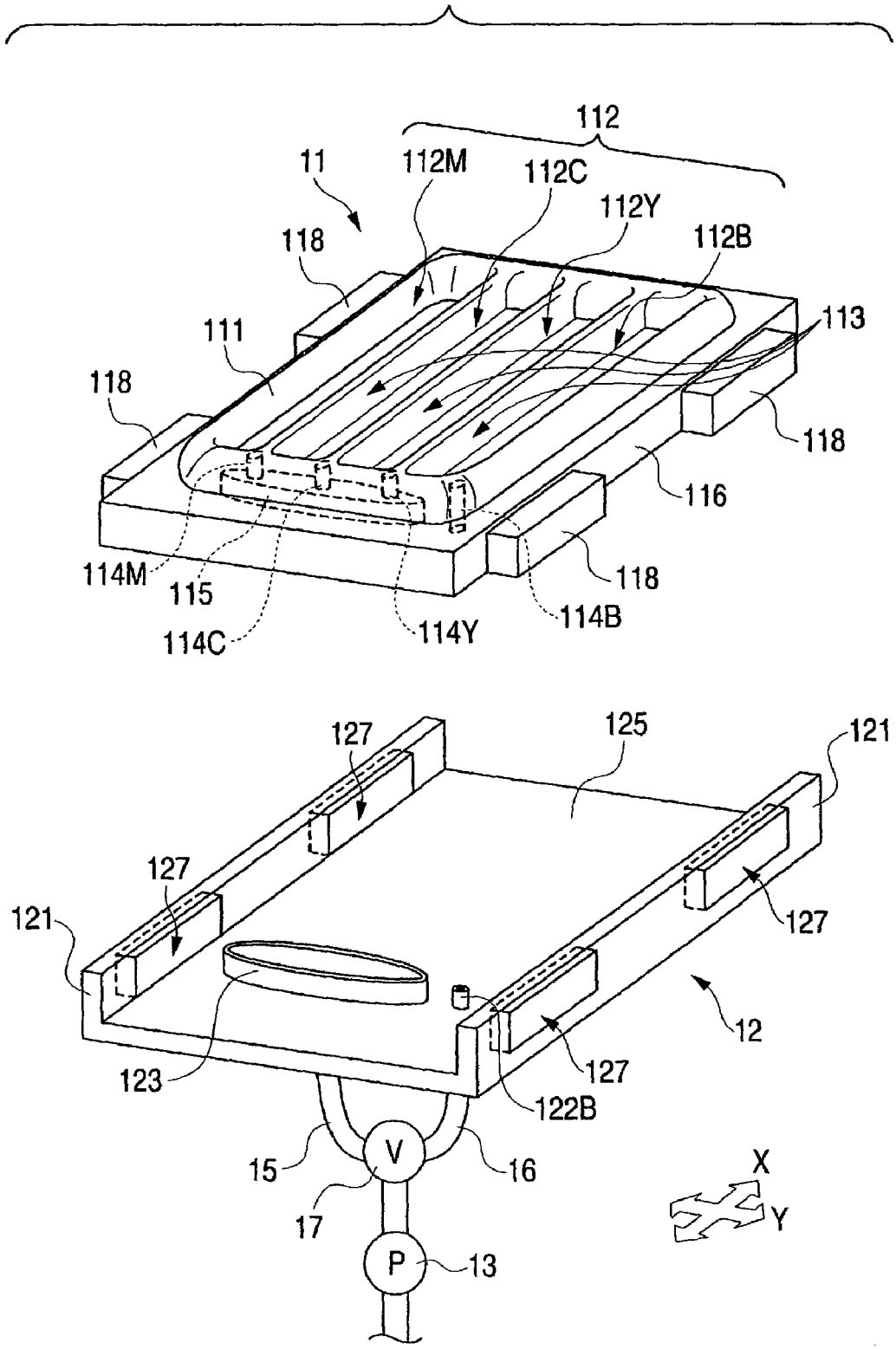
FIG. 4 is an enlarged view showing the recovery device of the nozzle head including the cap and a cap holder.
Figure 5A:
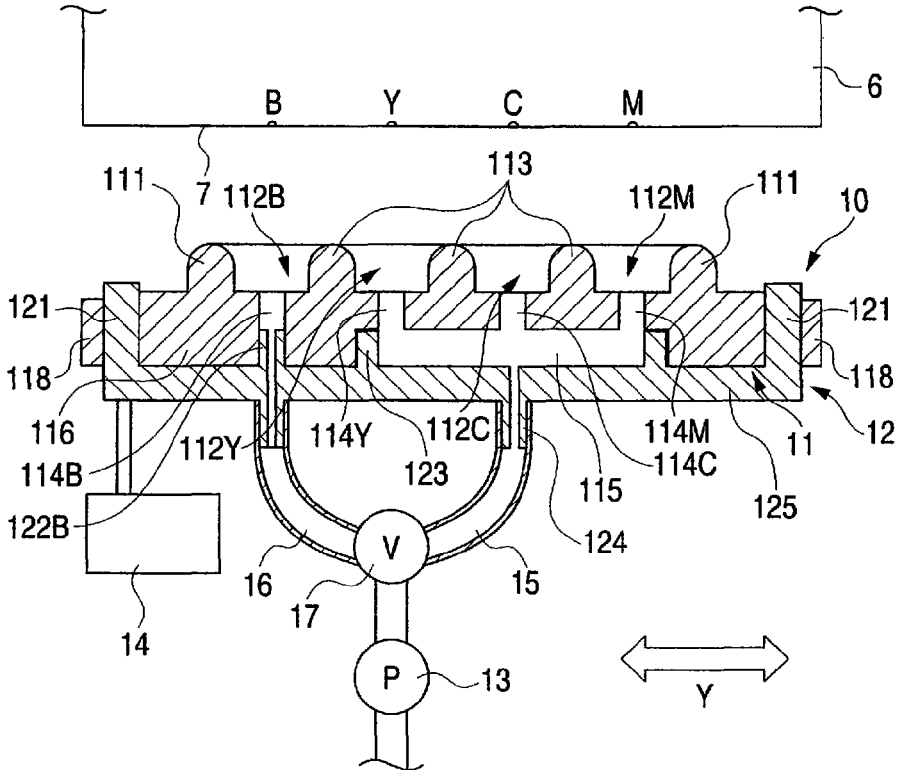
FIG. 5A is a conceptual view showing relation between the nozzle head and the recovery device in FIG. 1.

Then, the recovery device 10 will be described referring to FIGS. 3 to 5. As shown in FIGS. 3 to 5, the recovery device 10 includes a cap 11 which covers the nozzle face 7 of the nozzle head 6, a cap holder 12 for holding the cap 11, a suction unit 13 which functions as a negative pressure source for creating suction force by generating a negative pressure in a space formed by the nozzle face 7 and the cap 11, and a driving unit 14 for moving the cap 11 up and down with respect to the nozzle head 6. As also shown in FIG. 5A, the suction unit 13 is communicated with the cap 11.

Figure 5B:
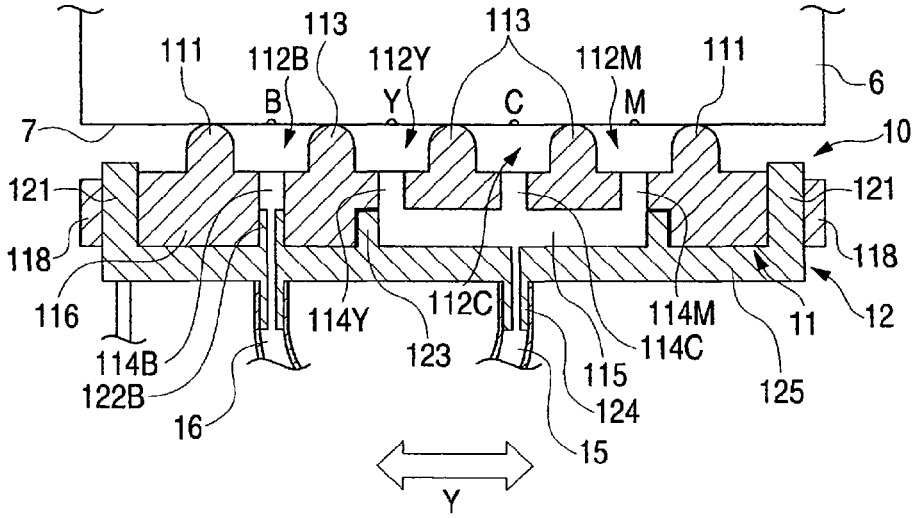
FIG. 5B shows a state where a nozzle face is covered with the cap.

The cap 11 is formed of elastic material. As shown in FIGS. 3A and 3B, the cap 11 is formed in a substantially box-like shape whose upper face is open, and has a cap substrate 116 which is rectangular in a plan view. A sealing lip 111 is formed in an annularly erected shape along an outer peripheral edge of the cap substrate 116 and inward at a slight distance from the edge. This sealing lip 111 covers the respective nozzle groups B, Y, C, M of the nozzle head 6, when it is brought into contact with the nozzle face 7. The sealing lip 111 has three partitioning lips 113 which partition an inside area of the sealing lip into four compartments 112B, 112Y, 112C, and 112M (generally represented by numeral 112) in the primary scanning direction Y. The three partitioning lips 113 are respectively formed in parallel with the nozzle groups and are disposed between the nozzle groups, when the cap 11 comes in contact with nozzle face 7. As shown in FIG. 5B, the compartments 112 are so arranged as to be respectively opposed to the nozzle groups B, Y, C, M when the nozzle face 7 of the nozzle head 6 is covered with the cap 11. The cap 11 is formed in a rectangular shape which has a rather longer side length in the secondary scanning direction than a side length in the primary scanning direction, in order to cover the nozzle groups when the cap 11 comes contact with the nozzle face 7. The cap substrate 116 has such a shape as to correspond to the rows of the nozzles which extend in the secondary scanning direction. The compartments 112 too have a rectangular shape in a plan view.

In the above described embodiment, a plurality of the nozzle groups are separated at equal intervals for respective colors of the inks, and therefore, the respective compartments 112 are arranged at equal intervals having the same width in the primary scanning direction. However, the compartments 112 need not necessarily be arranged at equal intervals, because sizes of the compartments 112 are appropriately determined corresponding to the respective nozzle groups to be partitioned. The sealing lip 111 and the partitioning lips 113 are formed having the same height, and their tip ends are rounded so that sealing performance can be secured with a small capping load.

The compartment 112B corresponding to the nozzle group B has a suction opening 114B which passes through the cap substrate 116 in a direction of the cap substrate's thickness. The suction opening 114B is disposed close to one side of the compartment 112B on the cap substrate 116 in the secondary scanning direction. Moreover, suction openings 114Y, 114C, 114M of the compartments 112Y, 112C, 112M corresponding to the nozzle groups for color inks are formed in the cap substrate 116 in a direction of the cap substrate's thickness, the suction openings 114Y, 114C, 114M are disposed close to one side of the compartments 112Y, 112C, 112M on the cap substrate 116 in the secondary scanning direction. Further, lower end parts of the suction openings 114Y, 114C, 114M are so formed as to be communicated with a common flow path 115 which is provided in the cap substrate 116. As shown in FIGS. 3A, 3B and 4, in the cap substrate 116, the common flow path 115 contains open areas of the suction openings 114Y, 114C, 114M. The common flow path 115 is a groove formed in the cap substrate 116, the common flow path 115 is formed in an oblong shape which is longer in the primary scanning direction, and the common flow path 115 opens at its lower face side.

The cap 11 has locking parts 118 to be locked to the cap holder 12 at both side edges of the cap substrate 116 in the primary scanning direction (both right and left side edges in FIG. 3A). Each of the locking parts 118 is provided near four corners of the cap substrate 116 so as to project outward from the cap substrate 116, two each of the locking parts 118 are opposed to each other on the side wall of cap substrate 116. Lower faces of the locking parts 118 are arranged along a lower face of the cap substrate 116 in the direction of its thickness. And upper faces of the locking parts 118 are stepped with respect to upper face of the cap substrate 116 in the thickness direction of the cap substrate 116, so that the stepped faces may be engaged with locked parts 127 of the cap holder 12, which will be described below.

Then, the cap holder 12 will be described. The cap holder 12 holds the cap 11 from an opposite side to the nozzle head 6. The cap holder 12 is formed in a substantially box-like shape having an open upper face, in the same manner as the cap 11, and has a holder substrate 125 in a rectangular shape in a plan view. Moreover, side walls 121 are uprightly provided along side edges of the holder substrate 125 in the secondary scanning direction. The cap holder 12 is molded of hard resin or the like. The cap holder 12 need not necessarily have a shape of a perfect box, provided that the two side walls 121 capable of supporting the cap 11 are provided on the four side edges of the holder substrate 125 uprightly at least in a manner opposed to each other, as shown in FIG. 4.

The holder substrate 125 is formed with a connection part 122B which has a smaller outer diameter than an inner diameter of the suction opening 114B of the cap 11. The connection part 122B is so formed as to project upward from the holder substrate 125, at a position opposed to the suction opening 114B. When the cap 11 is held by the cap holder 12, the connection part 122B is tightly contacted and engaged with an inside of the suction opening 114B to be communicated therewith keeping sealing performance. The connection part 122B is projected downward from the holder substrate 125, and connected to a suction tube 16 which is communicated with the suction unit 13, which will be described below. Since an inside of the connection part 122B is hollow, the suction opening 114B is communicated with the suction tube 16 through the connection part 122B.

The holder substrate 125 is further formed with a coupling hole 123 in an oblong shape which has a smaller outer diameter than an inner diameter of the common flow path 115 in the primary scanning direction and in the secondary scanning direction. The coupling hole 123 is formed so as to protrude upward from the holder substrate 125, at a position opposed to the common flow path 115. When the cap 11 is held by the cap holder 12, the coupling hole 123 is tightly contacted and engaged with an inside of the common flow path 115 thereby to be communicated with the common flow path 115 keeping sealing performance. Still further, a connection part 124 projecting downward from the holder substrate 125 is formed in the holder substrate 125 substantially at a center inside the coupling hole 123. The connection part 124 has substantially the same diameter and the same shape as the connection part 122B, and connected to a suction tube 15, which will be described below. Since an inside of the connection part 124 is hollow, the common flow path 115 which opens downward in the bottom of the cap 11 can be communicated with the connection part 124. Consequently, when the cap 11 is engaged with the cap holder 12, communication is created through the suction openings 114Y, 114C, 114M, the common flow path 115, the connection part 124, and the suction tube 15.

In order to enhance the sealing performance between the cap 11 and the cap holder 12, the following improvements may be made. Specifically, sealing ribs extending downward are formed on an outer peripheral edge of the suction opening 114B and on an outer peripheral edge of the common flow path 115. On the other hand, the connection part 122B extending upward from the holder substrate 125 of the cap holder 12 and the coupling hole 123 are increased in length. With this structure, overlapped regions of the two members are increased, whereby the sealing performance can be enhanced.

In addition, both the side walls 121 of the cap holder 12 are provided with the locked parts 127 to which the locking parts 118 of the cap 11 are locked. The locked parts 127 are formed passing through the sidewalls 121 in the primary scanning direction, at positions corresponding to the locking parts 118. When the cap 11 is contained inside the side walls 121, the locking parts 118 formed on the cap 11 are respectively inserted into the locked parts 127, and the locking parts 118 are locked to the locked parts 127, whereby the cap 11 is held so as not to be accidentally detached from the cap holder 12. On this occasion, communication is also created through the suction opening 114B, the common flow path 115, the connection part 122B, and the coupling hole 123. That is, the suction opening 114B is communicated with the connection part 122B, and the common flow path 115 is communicated with the coupling hole 123.

The suction tube 16 connected to the connection part 122B for the black ink and the suction tube 15 connected to the connection parts 124 for the color inks are connected to the suction unit 13 by way of a common switch valve 17.

As shown in FIGS. 5A and 5B, the driving unit 14 can move the cap holder 12 up and down with respect to the nozzle head 6. As described below, in case where the cap 11 is provided with the partitioning lips 113 which are lower than the sealing lip 111, a capping load can be varied with the driving unit 14 by adjusting butting condition between the cap 11 and the nozzle face 7 at a sucking time and maintaining time of the nozzle head 6.

Then, a method of recovering the nozzle head 6 employing this recovery device 10 will be described referring to FIGS. 5A and 5B. FIGS. 5A and 5B is a conceptual view showing relation between the nozzle head 6 and the recovery device 10.

As a first step, in the inkjet image forming apparatus 1, the head holder 2 is moved toward the recovery device 10 so that the nozzle face 7 of the nozzle head 6 may be opposed to the cap 11 which has been mounted on the cap holder 12, that is, to take a position as shown in FIG. 5A. Then, the driving unit 14 drives the cap holder 12 to move toward a side of the nozzle head 6, and brings tip ends of the sealing lip 111 and the partitioning lips 113 of the cap 11 into contact with the nozzle face 7 to take such a position that the cap 11 covers the nozzle face 7. On this occasion, the compartments 112 of the cap 11 respectively enclose the corresponding nozzle groups B, Y, C, M. Then, the suction unit 13 is driven, after switching the common switch valve 17 to the suction tube 15 for the color inks, and so, negative pressures are simultaneously created in the respective compartments 112Y, 112C, 112M corresponding to the nozzle groups Y, C, M for the color inks thereby to generate suction forces. In this manner, the respective inks are exhausted from the respective nozzle groups Y, C, M. On this occasion, pressures applied to the respective compartments 112Y, 112C, 112M are made substantially equal, because the pressures are applied through the common flow path 115 for the color inks, and so, deformations of the sealing lip 111 and the partitioning lips 113 between the compartments 112 corresponding to the nozzle groups Y, C, M are unlikely to occur. Moreover, because the partitioning lips 113 are provided inside the sealing lip 111, deformation of the cap substrate 116 such as warping upward is unlikely to occur, even though the negative pressures are exerted on the respective compartments 112. Because the partitioning lips 113 are formed at equal intervals inside the sealing lip 111, deforming force exerted on the cap substrate 116 can be dispersed, and therefore, it is possible to uniform the deforming force exerted on the whole of the cap 11. Accordingly, such inconveniences that the cap substrate 116 may get in touch with the nozzle face 7 due to its deformation will not occur, and hence, the function of the nozzle head 6 can be effectively recovered. In addition, because the cap 11 is unlikely to be deformed, the cap 11 can be so designed that the sealing lip 111 and the partitioning lips 113 have low heights, and the cap substrate 116 has a thin wall thickness, whereby the recovery device 10 can be made compact.

After exhaustions of the inks from the respective nozzle groups Y, C, M have finished, the common switch valve 17 is switched to the suction tube 16 for the black ink thereby to exhaust the black ink from the nozzle group B for the black ink. When the exhaustions of the inks from all the nozzle groups B, Y, C, M have finished in this manner, the suction unit 13 stops. At the same time, the driving unit 14 drives the cap holder 12 to retreat, and separates the cap 11 from the nozzle face 7. The inks which have been exhausted are forwarded to a waste liquid tank, which is not shown, and absorbed by absorbing material in the waste liquid tank.

When the suction unit 13 stops, the negative pressure inside the cap 11 tends to return to atmospheric pressure, in a few seconds while the suction is interrupted and the cap 11 is driven by the driving unit 14 to be retreated downward and separated from the nozzle face 7. For this reason, there is such possibility that the exhausted-inks which have been mixed in the cap may flow back to the nozzle head 6 and even to the ink tank through the nozzle groups B, Y, C, M.

However, according to the inkjet image forming apparatus 1 in this embodiment, because the black ink and a plurality of the color inks are separately exhausted, the black ink and a plurality of the color inks can be prevented from being mixed together, in addition to a merit of preventing deformation of the cap 11. Further, in this embodiment, the nozzle groups for ejecting a plurality of the color inks are partitioned by the partitioning lips 113 for the respective colors, and exhausted through the common flow path 115 for the compartments 112Y, 112C, 112M. Therefore, the color inks are not mixed in the compartments 112Y, 112C, 112M, but mixed in the common flow path 115 or the coupling hole 123. As the results, the exhausted ink having mixed colors and high concentration is prevented from directly getting in touch with the nozzle face, and a time until the exhausted ink flows back to the nozzle head 6 can be prolonged. In this manner, the back flow in a few seconds until the cap 11 is separated from the nozzle face 7, as described above, can be prevented.

Moreover, the black ink is the pigment ink, while the yellow, cyan and magenta inks are the dye inks. Therefore, it is prevented that the black ink becomes massed together with the color inks by separately exhausting the inks in this manner, the black ink and the color inks can be prevented from being coagulated, whereby clogs at the nozzle groups B, Y, C, M and clogs in the flow paths in the recovery device after the suction openings can be avoided. Additionally, the black ink and the color inks can be prevented from being mixed together. In case where the black ink ejected from the nozzle group B is the dye ink, while the inks ejected from the nozzle groups Y, C, M are pigment inks, it is also possible to prevent the colors from being mixed together.

On the other hand, while an image forming process is not executed in the inkjet image forming apparatus 1, the driving unit 14 drives the cap holder 12 to move toward the nozzle head 6 from the position where the cap 11 is opposed to the nozzle face 7 of the nozzle head 6, and brings the tip ends of the sealing lip 111 and the partitioning lips 113 of the cap 11 into contact with the nozzle face 7, thereby to cover the nozzle face 7 with the cap 11. In this manner, the nozzle groups B, Y, C, M of the nozzle face 7 can be prevented from being dried or soiled with dust, and hence, it is possible to maintain the nozzle groups B, Y, C, M in a favorable state.

Figure 6A:
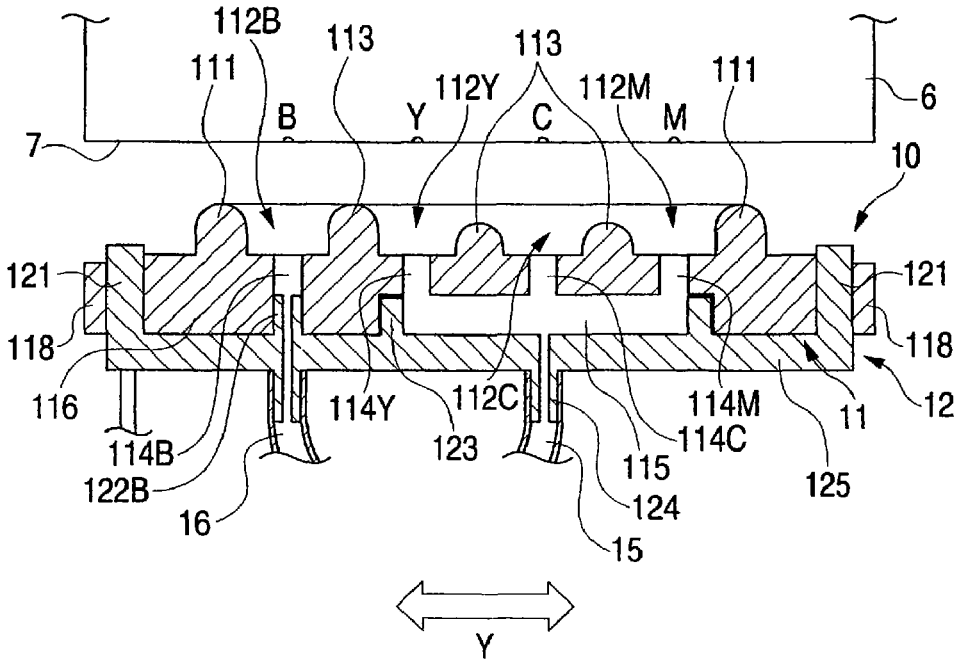
FIG. 6A is a conceptual view of another embodiment showing relation between the recovery device provided with the cap and the nozzle head.
Figure 6B:
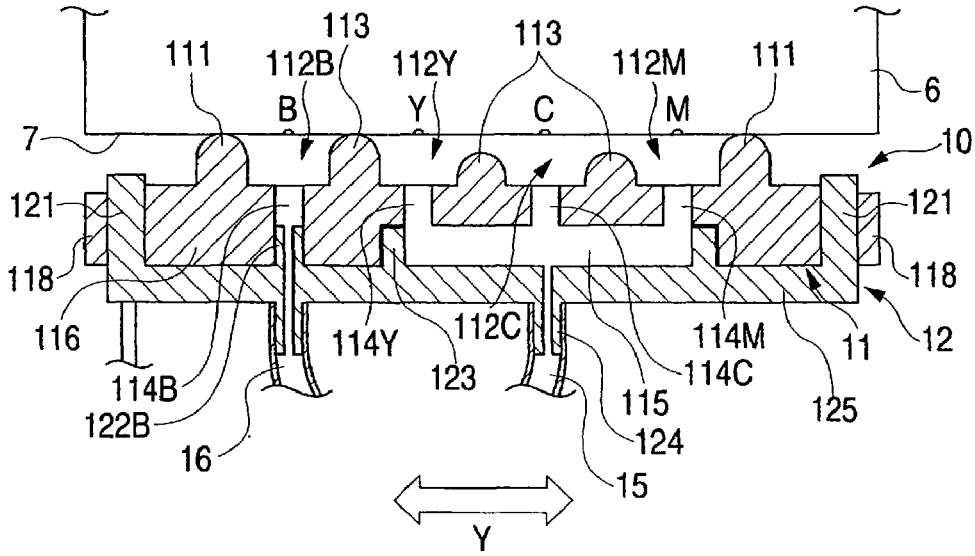
FIG. 6B shows the nozzle groups in a maintained state.

In the above described embodiment, an example in which the sealing lip 111 and the partitioning lips 113 have the same height has been described. However, by making at least one of the partitioning lips 113 lower than the sealing lip 111, as shown in FIGS. 6A and 6B, it is possible to perform capping without bringing this lower partitioning lip 113 into contact with the nozzle face 7. For example, as shown in FIGS. 6A and 6B, the partitioning lips 113 between the compartments 112Y, 112C, 112M corresponding to the nozzle groups Y, C, M for the color inks are made lower than the sealing lip 111. Then, the nozzle face 7 is covered with the cap 11, in a state where the sealing lip 111 and the partitioning lip 113 which is positioned between the compartment 112B corresponding to the nozzle group B for the black ink and the compartment 112Y corresponding to the nozzle group Y for the yellow ink are in contact with the nozzle face 7. By maintaining the nozzle groups B, Y, C, M in this manner, capping load exerted on the nozzle face 7 can be suppressed, and burden imposed on the nozzle head 6 can be reduced.

Figure 7A:
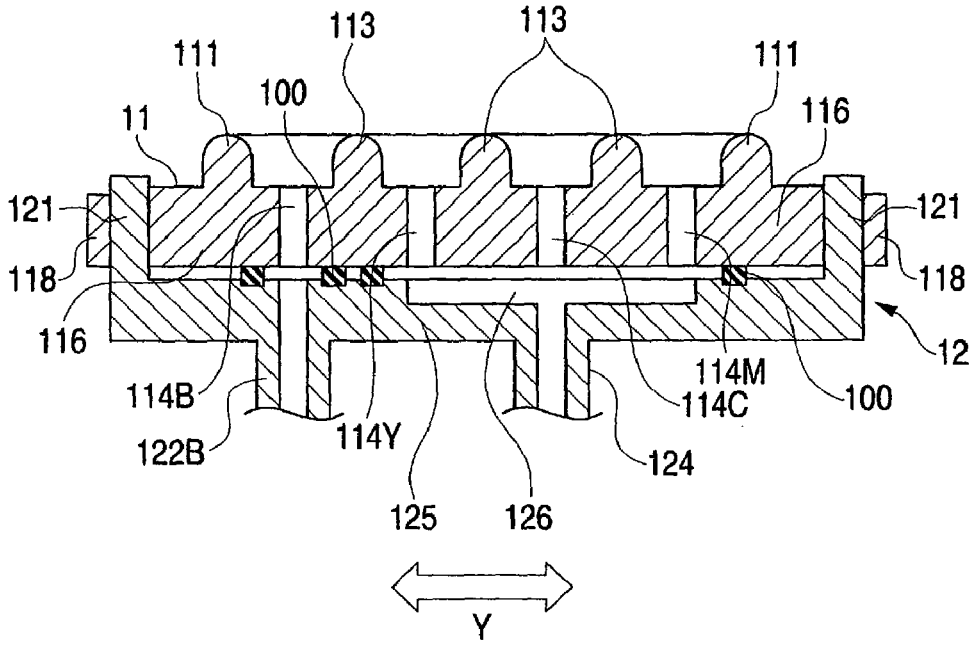
FIGS. 7A, 7B, and 7C respectively show other embodiments of the cap and the cap holder.
Figure 7B:
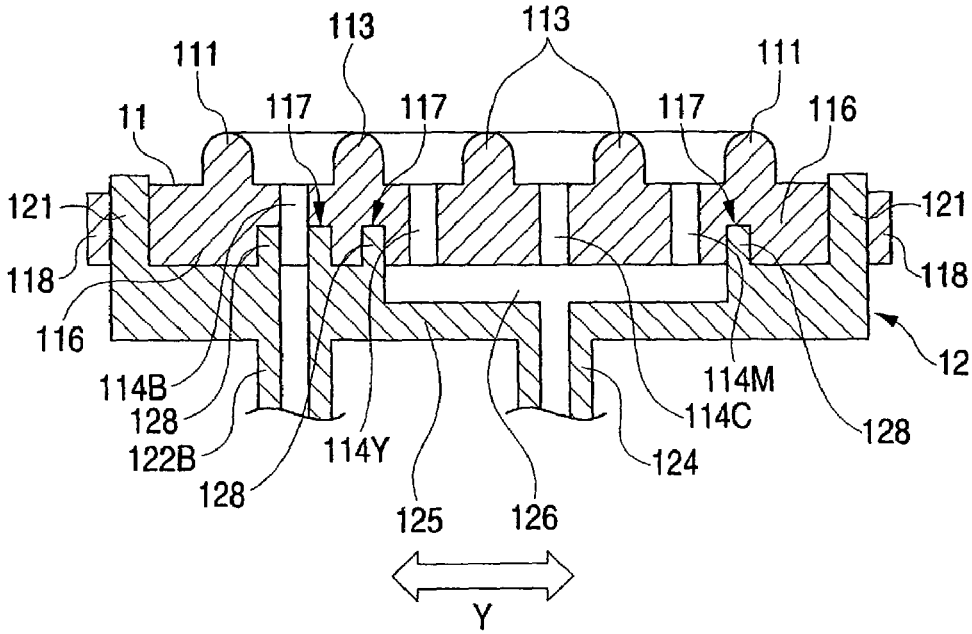

As another embodiment, it is possible to provide the common flow path 126 in the cap holder 12, as shown in FIGS. 7A and 7B. It is to be noted that explanation of the same structures as in the above described embodiment will be omitted in the following description.

Figure 7C:
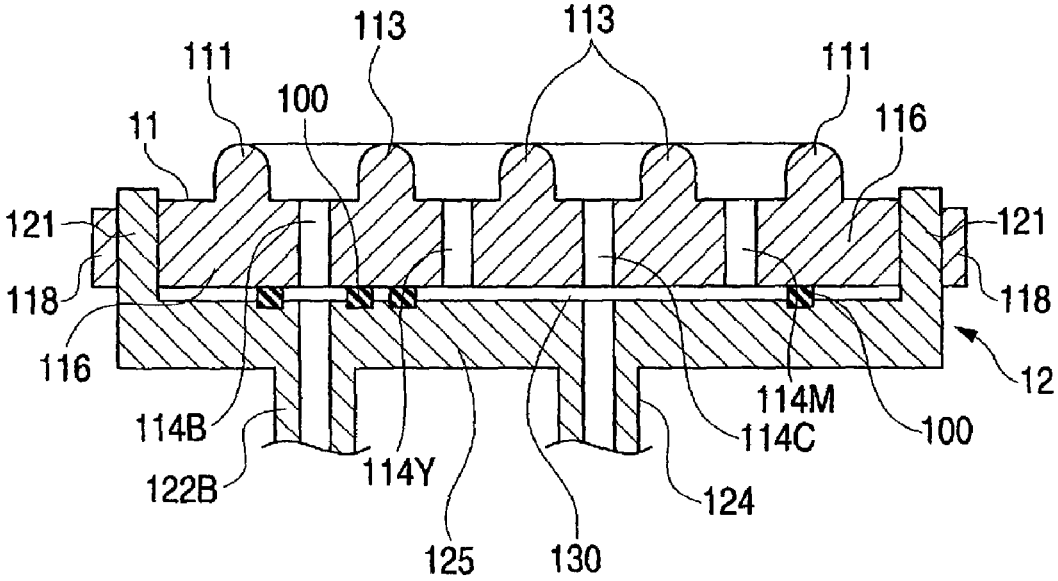

For example, as shown in FIG. 7A, the suction openings 114B, 114Y, 114C, 114M are formed in the cap 11 so as to pass through in a direction of the cap substrate's thickness. Moreover, a common flow path 126 and the connection part 122B are provided in the cap holder 12 on its face to be in contact with the cap 11. The common flow path 126 is formed by providing an oblong groove so as to contain a region including the suction openings 114Y, 114C, 114M for the color inks in the cap 11 and the connection part 124. The connection part 122B is arranged at a position opposed to the suction opening 114B. Packings 100 formed of rubber or the like are provided on either one of the faces of the cap 11 and the cap holder 12 which are opposed to each other so as to enclose the common flow path 126 and the connection part 122B, thereby to secure the sealing performance between the cap holder 12 and the cap 11. The packings 100 are clamped between the cap 11 and the cap holder 12 when they are engaged with each other. Moreover, when the cap 11 is brought into contact with the nozzle face 7 by the driving unit 14 at a time of sucking operation, the packings 100 come into tight contact with the faces of the cap 11 and the cap holder 12 with a pressing forces, whereby the sealing performance can be maintained. In case where the common flow path 126 is formed in the cap holder 12, in this manner, the cap can be easily formed, because it would be sufficient to form the suction openings 114Y, 114C, 114M passing through the cap substrate 116 in the direction of the cap substrate's thickness. Alternatively, as shown in FIG. 7C, it is also possible to utilize a space defined between the opposed faces of the cap 11 and the cap holder 12 in cooperation with the packings 100, as a common flow path 130, without forming an oblong groove in the cap holder 12. In this manner, a working step for forming the common flow path in the cap 11 or in the cap holder 12 becomes unnecessary, and both design and production can be simplified.

Further, as shown in FIG. 7B, annular projecting portions 128 may be provided around the common flow path 126 which is dented in the cap holder 12 and around the connection part 122B for the black ink, while annular grooves may be formed on the face of the cap substrate 116 opposed to the cap holder 12 thereby to form engaged parts 117. The sealing performance can be secured by inserting the projecting portions 128 of the holder 12 into these engaged parts 117. In this embodiment too, the cap 11 is engaged with the cap holder 12, and further, they are brought into tight contact with each other with the pressing force at the time when the driving unit drives the cap holder 12 to move toward the nozzle head 6. By contriving a shape of the cap holder 12 in this manner, the cap 11 can be easily formed. Because the cap holder 12 can be produced by integral molding, and the packing 100 need not be provided, advantage of cost reduction can be obtained.

In those embodiments which have been described above, a variety of the inks, such as the dye ink, pigment ink, black ink, a plurality of color inks can be separately sucked according to their purposes. In addition, it is also possible to suck an ink whose viscosity is liable to increase separately from other inks.

In case where the nozzle groups are inclined with respect to the primary scanning direction, the partitioning lips 113 may be also inclined so as to be in parallel with the nozzle groups.

Further, when the sucking operation is executed only in the nozzle head 6 which is provided with the nozzle groups for ejecting the black ink only, for example, it is possible to arrange the partitioning lips 113 at positions where the cap 11 is likely to be deformed in the sucking operation, and to provide a common flow path for all the suction openings of the compartments 112 which are defined by the partitioning lips 113, thereby to suck the ink simultaneously from the suction unit 13. In this manner, it is possible to perform the sucking operation, focusing on prevention of deformation of the cap.

Such being the above described structure, the cap can be prevented from being deformed, even in case where the area of the cap is increased due to an increase in number of the nozzle groups.

The present invention can provide the following illustrative, non-limiting embodiments:

(1) a recovery device for recovering the nozzle head having a nozzle face on which a plurality of nozzle groups are formed, the recovery device comprises a cap which covers the nozzle face of the nozzle head on which a plurality of the nozzle groups are formed; and a cap holder which holds the cap from an opposite side to the nozzle head. The cap includes a sealing lip surrounding the nozzle groups and capable of getting into contact with the nozzle face, a plurality of partitioning lips which partition an inside surrounded by the sealing lip into a plurality of compartments for the respective nozzle groups, and a plurality of suction openings which can exhaust liquid from the respective compartments. A common flow path which is communicated with some or all suction openings of some or all compartments and connects the suction openings to a negative pressure source is formed in the cap or in the cap holder, or by a space containing faces of the cap and the cap holder opposed to each other.

According to this recovery device, deformation of the sealing lip and the partitioning lip between the compartments can be suppressed, because pressures in the compartments are kept to be equal by means of the common flow path which is communicated with the suction openings of the compartments. And the liquids are sucked from the respective nozzle groups. Moreover, deformation of the bottom of the cap can be suppressed, because the partitioning lip is provided and the partitioning lip is unlikely to be deformed. Therefore, heights of the sealing lip and the partitioning lip can be made smaller. Further, the partitioning lip can be reinforced against deformation, since they can separate the nozzle groups into some groups corresponding to places where the cap is likely to be deformed. Still further, because the common flow path is formed in the cap or in the cap holder, or by the space containing the faces of the cap and the cap holder opposed to each other, it is possible to form the common flow path with a simple structure.

(2) In the recovery device of (1), the compartments are divided into at least one first compartment and a plurality of second compartments except for the first compartment. The respective suction openings of the second compartments are connected to the negative pressure source by way of the common flow path. And the suction opening of the first compartment is connected to the negative pressure source independently from the common flow path.

A plurality of the compartments are divided into at least the first compartment and a plurality of the second compartments, and the second compartments can suck the liquids by way of the common flow path. Consequently, the suction from the nozzle groups corresponding to the first compartment can be conducted separately to the suction from the nozzle groups corresponding to the second compartments according to purpose for the suction. For example, in case where the liquids to be sucked are exhausted separately, while deformations of the sealing lip, the partitioning lip, and the bottom of the cap are suppressed. As the results, it is possible to prevent troubles caused by mixture of the liquids.

(3) In the recovery device of (2), the nozzle group corresponding to the first compartment ejects black ink, and the nozzle groups corresponding to the second compartments eject a plurality of color inks.

According to the recovery device of (3), the black ink and the color ink can be exhausted without being mixed together, while deformations of the sealing lip, the partitioning lip, and the bottom of the cap are suppressed. Therefore, such possibility that the mixed inks having high concentration may enter into a plurality of the nozzle groups for the color inks to cause troubles can be decreased.

(4) In the recovery device of (3), the partitioning lip in the second compartments partitions the nozzle groups which eject a plurality of the color inks, for respective colors of the inks.

According to the recovery device of (4), a plurality of the color inks can be exhausted without being mixed with one another in the cap due to presence of the partitioning lip, but mixed at a downstream side, while deformations of the sealing lip, the partitioning lip, and the bottom of the cap are suppressed. Therefore, such possibility as causing troubles due to the mixed inks can be decreased. For example, the time until the mixed inks having high concentration enter into a plurality of the nozzle groups for the color inks can be prolonged.

(5) In the recovery device of (2), the nozzle group corresponding to the first compartment and the nozzle groups corresponding to the second compartments respectively eject the inks of different types. For example, one of the ink is pigment ink, the other of the ink is dye ink.

According to the recovery device of (5), even when the pigment ink is coagulated by dye ink's nature, the pigment ink and the dye ink are exhausted separately from the nozzle group corresponding to the first compartment and the nozzle groups corresponding to the second compartments. As the results, coagulation of the inks when they are exhausted in the mixed state can be prevented. In this manner, occurrence of inconveniences such as clogs in the flow paths of the liquids inside the recovery device or inside the nozzle head can be avoided, while deformations of the sealing lip, the partitioning lip, and the bottom of the cap are suppressed.

(6) In the recovery device of (5), the pigment ink is the black ink, and the dye ink is color ink. The dye ink may has a plurality of color inks.

According to the recovery device of (6), even when the pigment black ink is coagulated by dye color ink's nature, the pigment black ink and the dye color ink are ejected separately from the nozzle group corresponding to the first compartment and the nozzle groups corresponding to the second compartments. Therefore, not only both the pigment black ink can be prevented from being coagulated but also the pigment black ink and the dye color ink can be prevented from being mixed together.

(7) In the recovery device of (5), the nozzle group corresponding to the first compartment ejects the pigment black ink, and the nozzle groups corresponding to the second compartments eject a plurality of the dye color inks. The partitioning lip in the second compartments partitions the nozzle groups which eject a plurality of the color inks, for respective colors of the inks.

According to the recovery device of (7), in recovering operation in which the black ink is coagulated by dye ink's nature when mixed together, such possibility as causing troubles due to the mixed inks can be decreased. For example, coagulation can be prevented, mixing of the colors can be prevented, and the time until the mixed inks having high concentration enter into a plurality of the nozzle groups for the color inks can be prolonged.

(8) In the recovery device of (1), the common flow path is formed between the cap and the cap holder.

According to the recovery device of (8), because the common flow path is formed by the cap and the cap holder which are supported by each other, it is possible to form the common flow path with a simple structure of the cap and the cap holder.

(9) In the recovery device of (1), the partitioning lip includes a plurality of partitioning lips, at least one of the partitioning lips is formed shorter than the sealing lip.

According to the recovery device of (9), it is possible to perform capping, without bringing the partitioning lip which are shorter than the sealing lip into contact with the nozzle face, at the time of non-image forming operation. In this manner, burden imposed on the nozzle head on occasion of keeping the nozzle groups can be reduced.

(10) In the recovery method, a nozzle head has a nozzle face on which a plurality of nozzle groups are formed, the nozzle face is covered with a cap held by a cap holder at a time of sucking and/or at a time of non-image forming operation, thereby to eject liquids from a plurality of the nozzle groups formed on the nozzle face. A sealing lip provided on the cap in a projected manner is brought into contact with the nozzle face, a plurality of partitioning lips for partitioning an inside of the sealing lip into a plurality of compartments for the respective nozzle groups are brought into contact with the nozzle face, thereby to exhaust the liquids through respective suction openings in the compartments. Pressures in the compartments are kept to be substantially equal by means of a common flow path which is communicated with the suction openings in some or all of the compartments and formed in the cap or in the cap holder, or by a space containing faces of the cap and the cap holder opposed to each other, thereby to exhaust the liquids.

According to the recovery method of (10), the pressures in some or all of the compartments are kept to be equal thereby to suck the liquids from the respective nozzle groups at the same time. Therefore, it is possible to exhaust the liquids, while deformations of the sealing lip, the partitioning lip, and the bottom of the cap are suppressed. Moreover, it becomes possible to exhaust the liquids without deforming the bottom of the cap, since the partitioning lip are provided and deformation of the partitioning lip is suppressed.

(11) In the recovery method (10), the compartments includes at least one first compartment and a plurality of second compartments, wherein the respective suction openings of the second compartments exhaust the liquids at the same time by means of the common flow path, and the suction opening of the first compartment exhausts the liquid independently from the common flow path.

According to the recovery method of (11), it is possible to separately conduct the suction from the nozzle group corresponding to the first compartment and the suction from the nozzle groups corresponding to the second compartments according to the purpose for the suction, for example, in case where the liquids to be sucked are separately exhausted, while deformations of the sealing lip, the partitioning lip, and the bottom of the cap are suppressed.

(12) In the recovery method (11), the nozzle group corresponding to the first compartment which ejects black ink exhausts the ink independently from the nozzle groups corresponding to the second compartments which eject a plurality of color inks.

According to this recovery method of (12), the black ink and the color ink can be exhausted without being mixed together, while deformations of the sealing lip, the partitioning lip, and the bottom of the cap are suppressed. Therefore, such possibility that the mixed inks having high concentration may enter into a plurality of the nozzle groups for the color inks to cause troubles can be decreased.

(13) In the recovery method (11), the nozzle group corresponding to the first compartment and the nozzle groups corresponding to the second compartments respectively eject the different inks. One of the ink is pigment ink and the other ink is dye ink. The respective inks are exhausted independently from each other.

According to the recovery method of (13), since the pigment ink is coagulated by the dye ink's nature when mixed together, coagulation of the pigment ink when they are exhausted in the mixed state can be prevented, at a time of recovering operation. Therefore, occurrence of inconveniences such as clogs in the flow paths of the liquids inside the recovery device or inside the nozzle head can be avoided, while deformations of the sealing lip, the partitioning lip, and the bottom of the cap are suppressed.

(14) In the recovery method (13), the nozzle group corresponding to the first compartment which ejects the pigment black ink exhausts the ink independently from the nozzle groups corresponding to the second compartments which eject a plurality of the dye color inks.

According to the recovery method of (14), in recovering operation in which the black ink is coagulated by the dye color ink's nature when mixed together, such possibility as causing troubles due to the mixed inks can be decreased. For example, coagulation can be prevented, mixing of the colors can be prevented, and the time until the mixed inks having high concentration enter into a plurality of the nozzle groups for the color inks can be prolonged.

(15) In the recovery method (10), the partitioning lip includes a plurality of partitioning lips, at least one of the partitioning lips are formed shorter than the sealing lip, whereby at a time of sucking, the sealing lip and the partitioning lip are brought into contact with the nozzle face, and at a time of non-image forming operation, only the sealing lip is brought into contact with the nozzle face.

According to the recovery method of (15), because the sealing performances of the respective compartments are secured at the time of sucking operation, it is possible to exhaust the liquids from the corresponding nozzle groups, while the pressure in the respective compartments are kept to be equal. On the other hand, at the time of non-image forming operation, the capping is performed by bringing only the sealing lip into contact with the nozzle face, and therefore, it is possible to achieve maintenance of the nozzle groups with a small burden on the nozzle head.

What is claimed is:

1. A recovery device for a nozzle head that has a nozzle face in which a plurality of nozzle groups are formed, the recovery device comprising:

a cap configured to cover the nozzle face in which a plurality of nozzle groups are formed; and a cap holder supporting the cap;

wherein the cap includes:

a sealing lip being configured to sealingly contact the nozzle face in a state in which the sealing lip covers the nozzle groups;

a plurality of partitioning lips that partition an inside area surrounded by the sealing lip into a plurality of compartments corresponding to the respective nozzle groups; and a plurality of suction openings provided in the respective compartments, liquid can be exhausted through the suction openings; and wherein a common flow path, which is communicated with suction openings of some or all compartments and connects the suction openings to a negative pressure source, is formed in the cap or in the cap holder, or by a space containing faces of the cap and the cap holder opposed to each other.

2. The recovery device according to claim 1, the compartments are divided into a first compartment and second compartments except for the first compartment, the suction openings of the second compartments are connected to the negative pressure source by way of the common flow path, and the suction opening of the first compartment is connected to the negative pressure source independently from the common flow path.

3. The recovery device according to claim 2, wherein when the cap is opposed to the nozzle face, the first compartment is opposed to the nozzle group that ejects black ink and the second compartments are opposed to the nozzle groups that exhausts a plurality of color inks.

4. The recovery device according to claim 3, wherein the partitioning lips partition the nozzle groups that eject the color inks, for respective colors of the color inks.

5. The recovery device according to claim 3, wherein one of the first compartment and the second compartments is opposed to the nozzle group that ejects pigment ink, the other of the first compartment and the second compartments is opposed to the nozzle groups that eject dye ink.

6. The recovery device according to claim 5, the pigment ink includes black ink, and the dye ink includes a plurality of the color inks.

7. The recovery device according to claim 6, wherein the compartments partitioned by the portioning lips in the second compartments are opposed to the nozzle groups that eject the color inks, for respective colors of the dye ink.

8. The recovery device according to claim 1, wherein the cap has a recess that is communicated with the suction openings; and the cap holder has a connection part that has a corresponding form with respect to the recess so as to be fitted in the recess;

the common flow path is formed with the recess and the connection part.

9. The recovery device according to claim 1, wherein at least one of the partitioning lips is shorter than the sealing lip.

10. A recovery method for a nozzle head that has a nozzle face in which a plurality of nozzle groups are formed, the recovery method comprising the steps of:

covering the nozzle face with a cap supported by a cap holder;

contacting a sealing lip disposed on the cap to the nozzle face;

partitioning an inside area surrounded by the sealing lip into a plurality of compartments corresponding to the respective nozzle groups with a plurality of partitioning lips;

keeping pressure of some or all compartments to be substantially equal through a common flow path, the common flow path is communicated with suction openings provided in the some or all compartments, the common flow path is formed in the cap or in the cap holder, or by a space containing faces of the cap and the cap holder opposed to each other;

exhausting liquid from the nozzle head in a state in which pressure of the some or all compartments is kept to be substantially equal.

11. The recovery method according to claim 10, wherein in the partitioning step, the compartments are divided into at least one first compartment and a second compartments except for the first compartment; and wherein, in the exhausting step, the suction openings of the second compartments exhaust liquid by way of the common flow path, and the suction opening of the first compartment exhaust liquid independently from the common flow path.

12. The recovery method according to claim 11, wherein in the exhausting step, black ink is exhausted bay way of the first compartment and a plurality of the color inks are exhausted by way of the second compartments.

13. The recovery method according to claim 11, wherein in the exhausting step, pigment ink is exhausted bay way of one of the first compartment and the second compartments, dye ink is exhausted by way of the other of the first compartment and the second compartments, and the pigment ink is exhausted independently from the dye ink.

14. The recovery method according to claim 13, wherein in the exhausting step, the pigment ink includes black ink, and the dye ink includes a plurality of the color inks.

15. The recovery method according to claim 10, wherein at least one of the partitioning lips is shorter than the sealing lip; and wherein in the contacting step, when liquid in the nozzle head is suctioned, both the sealing lip and partitioning lips come contact with the nozzle face, and when the nozzle head is in non image forming operation, only the sealing lip comes contact with the nozzle face.

* * * * *